US009700758B1

(12) United States Patent
Goldberg

(10) Patent No.: US 9,700,758 B1
(45) Date of Patent: Jul. 11, 2017

(54) FINGER/HAND EXERCISER

(71) Applicant: Elliott Goldberg, Scarsdale, NY (US)

(72) Inventor: Elliott Goldberg, Scarsdale, NY (US)

( * ) Notice: Subject to any disclaimer, the term of this patent is extended or adjusted under 35 U.S.C. 154(b) by 97 days.

(21) Appl. No.: 14/712,815

(22) Filed: May 14, 2015

Related U.S. Application Data

(63) Continuation-in-part of application No. 14/518,448, filed on Oct. 20, 2014, now Pat. No. 9,421,419, and a continuation-in-part of application No. 14/668,011, filed on Mar. 25, 2015.

(51) Int. Cl.
*A63B 23/16* (2006.01)
*A63B 21/02* (2006.01)
*A63B 21/00* (2006.01)

(52) U.S. Cl.
CPC ..... *A63B 23/16* (2013.01); *A63B 21/023* (2013.01); *A63B 21/1469* (2013.01)

(58) Field of Classification Search
CPC ..... A63B 23/16; A63B 23/12; A63B 23/035; A63B 23/00; A63B 21/00; A63B 21/40; A63B 21/4019; A63B 21/4035; A63B 21/4039; A63B 21/4045; A63B 21/0061; A63B 21/00065; A63B 21/00076; A63B 21/00185; A63B 21/02; A63B 21/023
USPC ..... 482/44–50, 139, 121–130
See application file for complete search history.

(56) References Cited

U.S. PATENT DOCUMENTS 1,136,481 A * 4/1915 Ostrovsky ..... G09B 15/06 482/47
1,796,216 A * 3/1931 Pettersson ..... A63B 23/16 482/47
2,947,211 A 8/1960 Shuman
3,447,415 A * 6/1969 Kime ..... G09B 15/06 267/177
3,738,651 A * 6/1973 Norman ..... A63B 23/16 482/128
3,847,051 A * 11/1974 Miller ..... G10D 7/10 84/387 A
3,937,116 A 2/1976 Ramirez
4,678,181 A * 7/1987 Ditsch ..... A63B 23/16 482/128
D294,614 S 3/1988 Ditsch et al.
4,778,173 A * 10/1988 Joutras ..... A63B 5/20 482/108
D325,411 S 4/1992 Everly
5,147,256 A * 9/1992 Silagy ..... A63B 23/16 482/128
D352,754 S * 11/1994 Silagy ..... D21/684
D359,779 S 6/1995 Peters et al.
5,431,611 A * 7/1995 Silagy ..... A63B 23/16 482/122
D405,134 S 2/1999 Hug
D416,299 S 11/1999 Hug
(Continued)

*Primary Examiner* — Stephen Crow
*Assistant Examiner* — Garrett Atkinson
(74) *Attorney, Agent, or Firm* — Weiner & Burt, P.C.; Irving M. Weiner; Pamela S. Burt

(57) ABSTRACT

A hand and finger exercise apparatus to exercise fingers or compress the entire apparatus for complete hand and forearm strengthening, and to replace interchangeable finger button pieces with different resistance. The apparatus permits the user to easily and quickly change resistance to any finger by changing the finger button piece. The finger buttons snap into the base with ease, and are removed with ease.

9 Claims, 7 Drawing Sheets

(56) References Cited

U.S. PATENT DOCUMENTS

| | | | | |
|---|---|---|---|---|
| D418,180 | S | 12/1999 | Hug | |
| D418,560 | S | 1/2000 | Hug | |
| D419,210 | S | 1/2000 | Hug | |
| 7,351,897 | B2 * | 4/2008 | Woods | A63B 21/023 84/385 A |
| 7,967,732 | B2 * | 6/2011 | D'Addario | A63B 21/023 482/44 |
| 8,702,569 | B2 * | 4/2014 | Martin | A63B 21/023 482/11 |
| 2003/0131710 | A1 | 7/2003 | Goldiner | |
| 2009/0318269 | A1 * | 12/2009 | D'Addario | A63B 21/023 482/47 |
| 2013/0196825 | A1 * | 8/2013 | Silagy | A63B 21/023 482/49 |

* cited by examiner

FINGER/HAND EXERCISER

CROSS-REFERENCE TO RELATED APPLICATIONS

The present application is a continuation-in-part of and claims priority from U.S. patent application Ser. No. 14/518,448 filed Oct. 20, 2014, and Ser. No. 14/668,011 filed Mar. 25, 2015.

BACKGROUND OF THE INVENTION

The present invention relates generally to improvements for a hand and finger exerciser apparatus of the type in which engaged elements or components are pressed against the resistance or urgence of resilient members, wherein the user is given the option of exercising fingers or the entire hand.

More particularly, the present invention relates a hand and finger exerciser apparatus as described hereinabove, wherein a plurality of interchangeable removable finger button pieces are connectible and cooperable with and slidable within a main base unit body structure, and each interchangeable removable finger button piece provides a predetermined resistance.

It is a desideratum of the present invention to avoid the animadversions of conventional finger/hand exercisers, and to provide an apparatus which can be used to exercise fingers or compress the entire apparatus for complete hand and forearm strengthening and to replace finger button pieces with different resistance.

SUMMARY OF THE INVENTION

The present invention provides a hand and finger exerciser apparatus, comprising: a main base unit body structure; a plurality of interchangeable removable finger button pieces connectible and cooperable with and slidable within said main base unit body structure; each said interchangeable removable finger button piece providing a first predetermined resistance to pushing said interchangeable removable finger button piece inwardly into said main base unit body structure; each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure; and wherein said first predetermined resistance is different than said second predetermined resistance.

An object of the invention is to provide an apparatus as described above enabling the user to interchange finger button pieces of different resistance.

A further object of the invention is to provide such an apparatus enabling the user to easily and quickly change resistance to any finger by changing the finger button.

Another object of the invention is to provide such an apparatus wherein finger buttons snap into the base with ease, and are removed with ease.

A further object of the invention is to provide an apparatus as described hereinabove wherein the base structure has a padded palm bar.

Further objects, advantages and features of the present invention will become apparent to those persons skilled in this particular area of technology and to others after being exposed to the following detailed specification and accompanying drawings.

DETAILED DESCRIPTION OF THE PRESENT INVENTION

Figure 1:
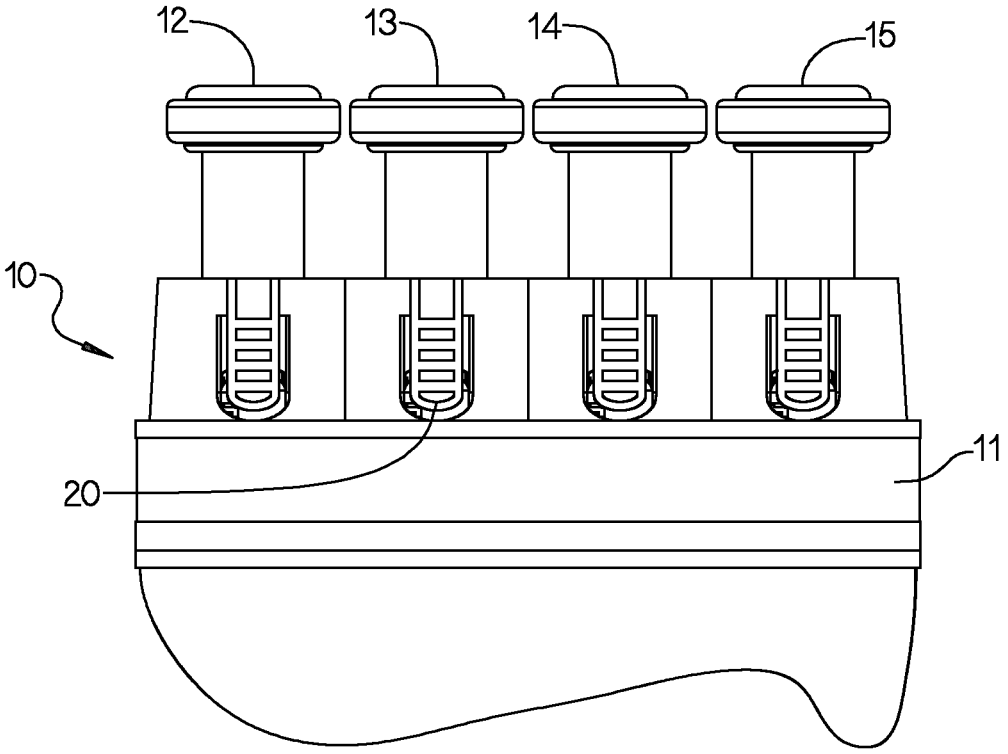
FIG. 1 is a front elevational view of an apparatus in accordance with a first embodiment of the present invention.

Referring to FIGS. 1-6, 9 and 10, there is shown an apparatus 10 in accordance with a first embodiment of the invention.

FIGS. 7-12 shows an apparatus 50 in accordance with a second embodiment which is similar in many respects to the first embodiment.

Like components are designated by like reference numbers.

The main difference between the first and second embodiments is the central guide member or pin 51 provided in the button receptacle 52 for its associated removable finger button piece 53.

The hand and finger exerciser apparatus 10 includes a main base unit body structure 11, and a plurality of interchangeable removable finger button pieces 12, 13, 14 and 15 connectible and cooperable with and slidable within the main base unit body structure 11.

Each interchangeable removable finger button piece provides a first predetermined resistance to pushing the interchangeable removable finger button piece inwardly into the main base unit body structure 11.

Each interchangeable removable finger button piece is provided with an associated cooperating locking/unlocking means forming part of the main base unit structure 11 for selectively and individually locking the interchangeable removable finger button piece to slide within the main base unit body structure 11 while preventing removal of the interchangeable removable finger button piece from the main base unit body structure 11, and for selectively and individually unlocking the interchangeable removable finger button piece for removal from the main base unit body structure 11 for replacement with another interchangeable removable finger button piece providing a second predetermined resistance to pushing the other interchangeable removable finger button piece downwardly or inwardly into the main base unit body structure 11.

The first predetermined resistance is different than the second predetermined resistance.

The base unit 11 is provided with four button receptacles 16, 17, 18 and 19 for the matching finger button pieces 12, 13, 14, and 15, respectively.

Figure 5:
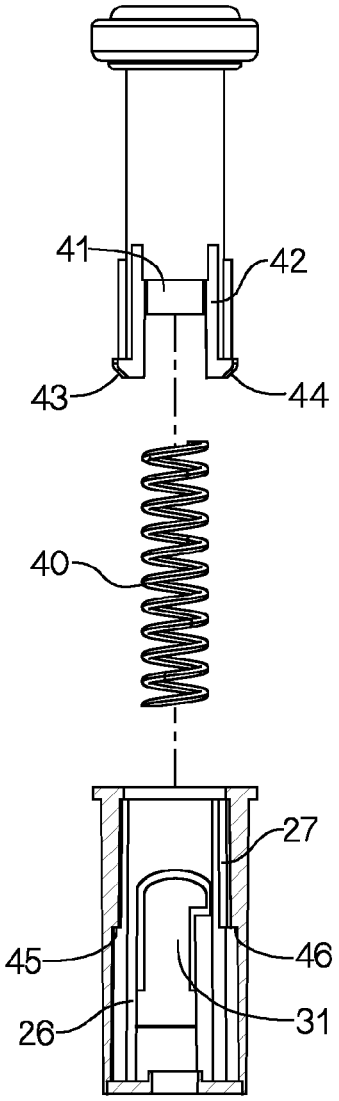
FIG. 5 is an exploded view of a finger button piece of the first embodiment.
Figure 4:
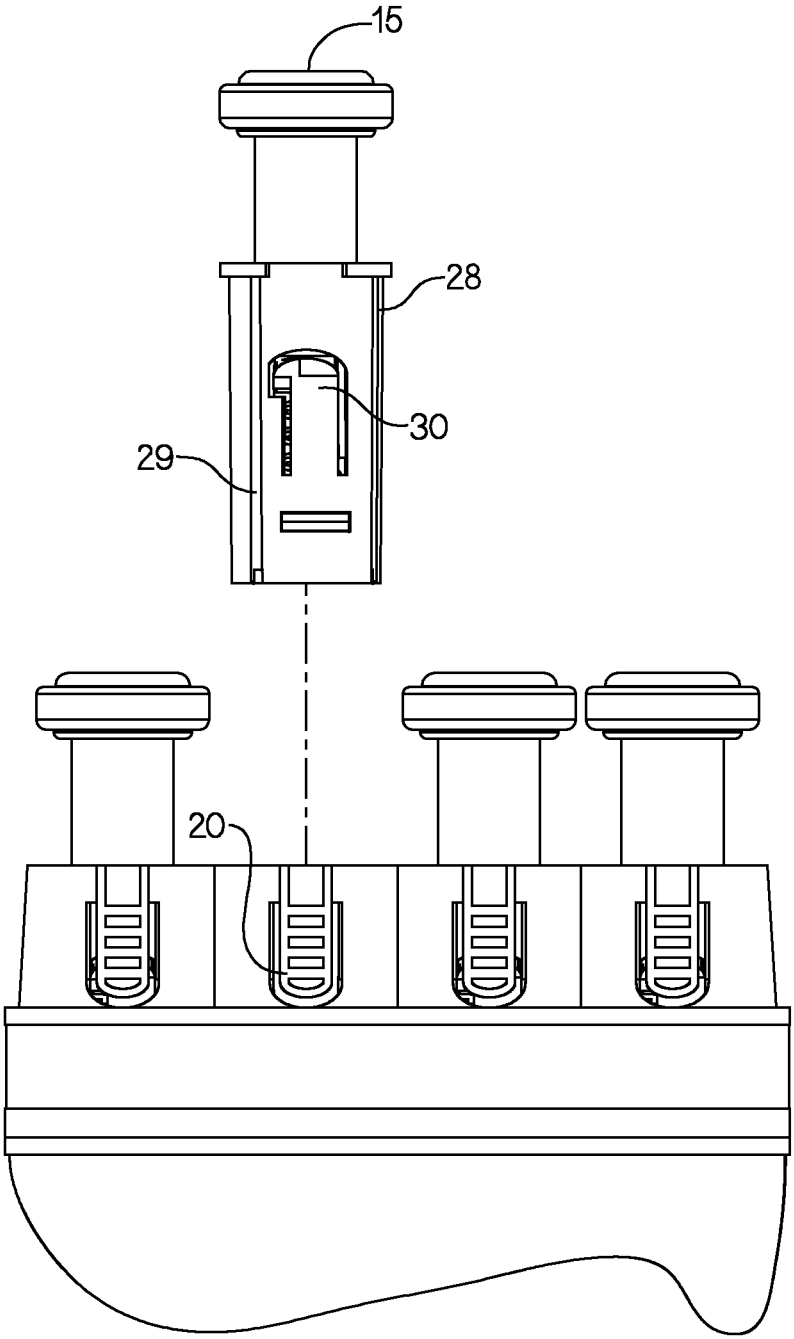
FIG. 4 illustrates a finger button piece removed from the first embodiment.

As shown in FIG. 5, each finger button piece is provided with a resilient resistance member, such as a spring 40, a cap member 41, a holder member 42, and abutments 43, 44, 45 and 46.

Each receptacle has a pair of pressible flexible tabs 20 and 21 formed in opposed walls of the receptacle.

Figure 2:
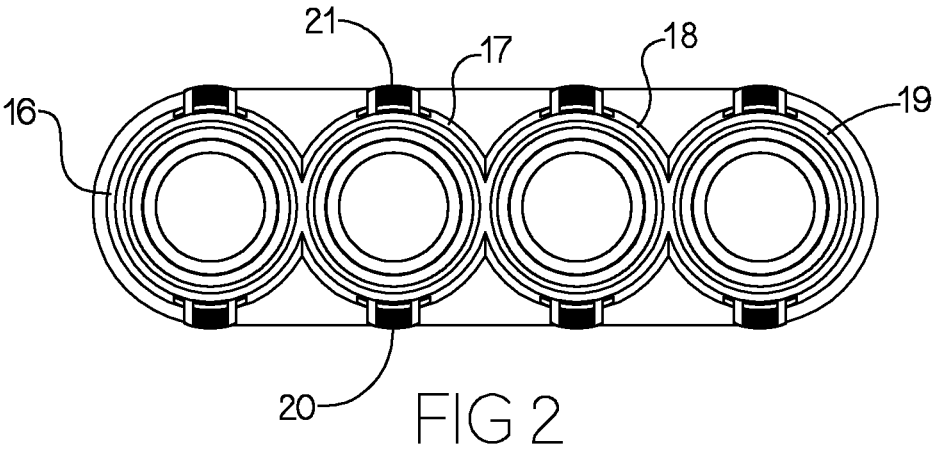
FIG. 2 is a top plan view of the FIG. 1 embodiment.
Figure 3:
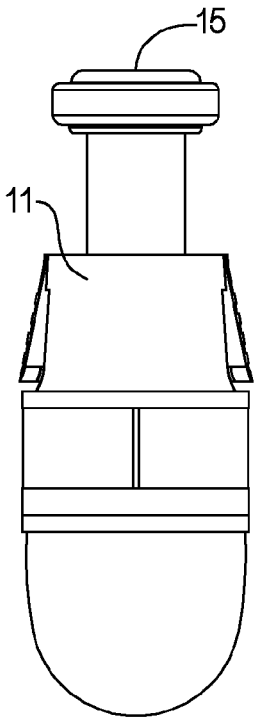
FIG. 3 is an end elevational view of the FIG. 1 embodiment.

As shown in FIG. 2, each flexible tab 20 and 21 is pivoted or cantilevered at one end to the base unit 11.

Figure 7:
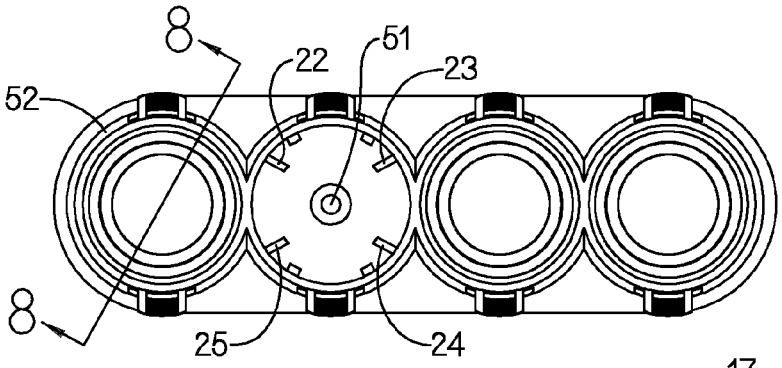
FIG. 7 depicts a top plan view of a second embodiment shown with one finger button removed.

Each receptacle has four main inwardly-projecting elongated members 22, 23, 24 and 25 as shown in FIG. 7.

The interchangeable removable finger button piece is provided with a plurality of elongated notches 26, 27, 28 and 29 which slidingly mate with the inwardly projecting elongated members 22, 23, 24 and 25, respectively, of the receptacle.

Each interchangeable removable finger button piece 12, 13, 14 or 15 is designed and dimensioned to slide within an associated one of the receptacles 16, 17, 18 or 19, respectively.

The locking/unlocking means includes a first flexible member 20 disposed on a side of the receptacle, and a second flexible member 21 disposed on an opposite side of the receptacle.

Pressing the first and second flexible members 20 and 21 toward each other permits removal of the finger button piece from its receptacle.

Each interchangeable removable finger button piece is provided with a third flexible member 30 disposed on a side of the finger button piece, and a fourth flexible member 31 disposed on an opposite side of the finger button piece.

Pressing the first and second flexible members 20 and 21 toward each other contacts and flexes the third and fourth flexible member 30 and 31, respectively, inwardly to permit removal of the finger button piece from its receptacle.

Figure 9:
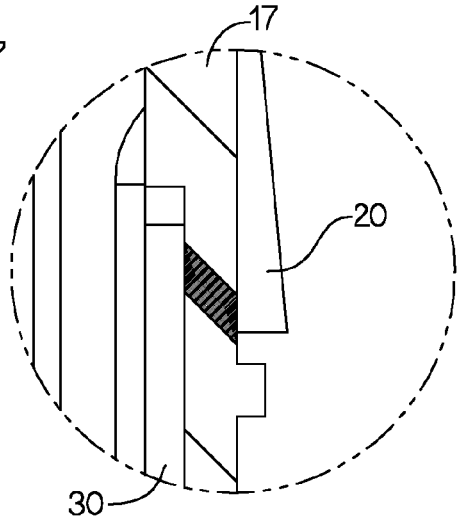
FIG. 9 is an exploded view showing the finger button piece in a locked position.
Figure 8:
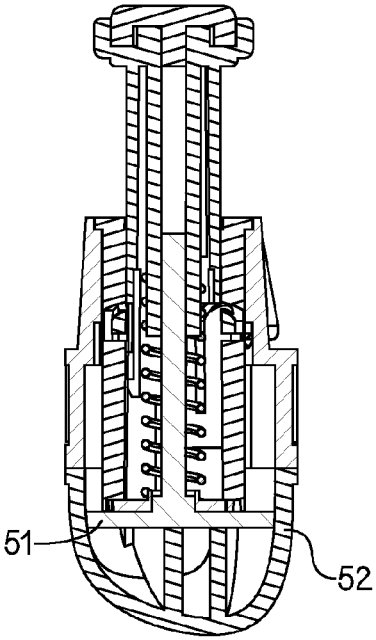
FIG. 8 shows a sectional view taken along the line 8-8 of FIG. 7.
Figure 10:
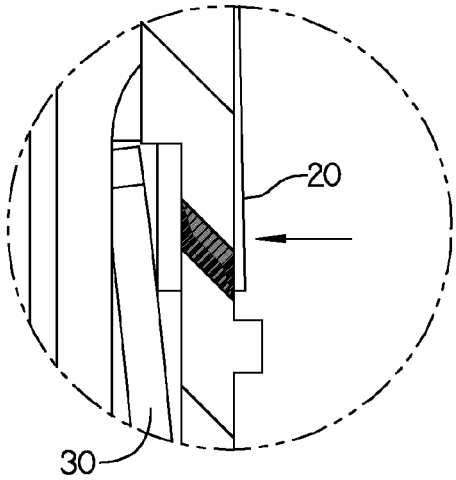
FIG. 10 is an exploded view showing the finger button piece in an unlocked position.
Figure 11:
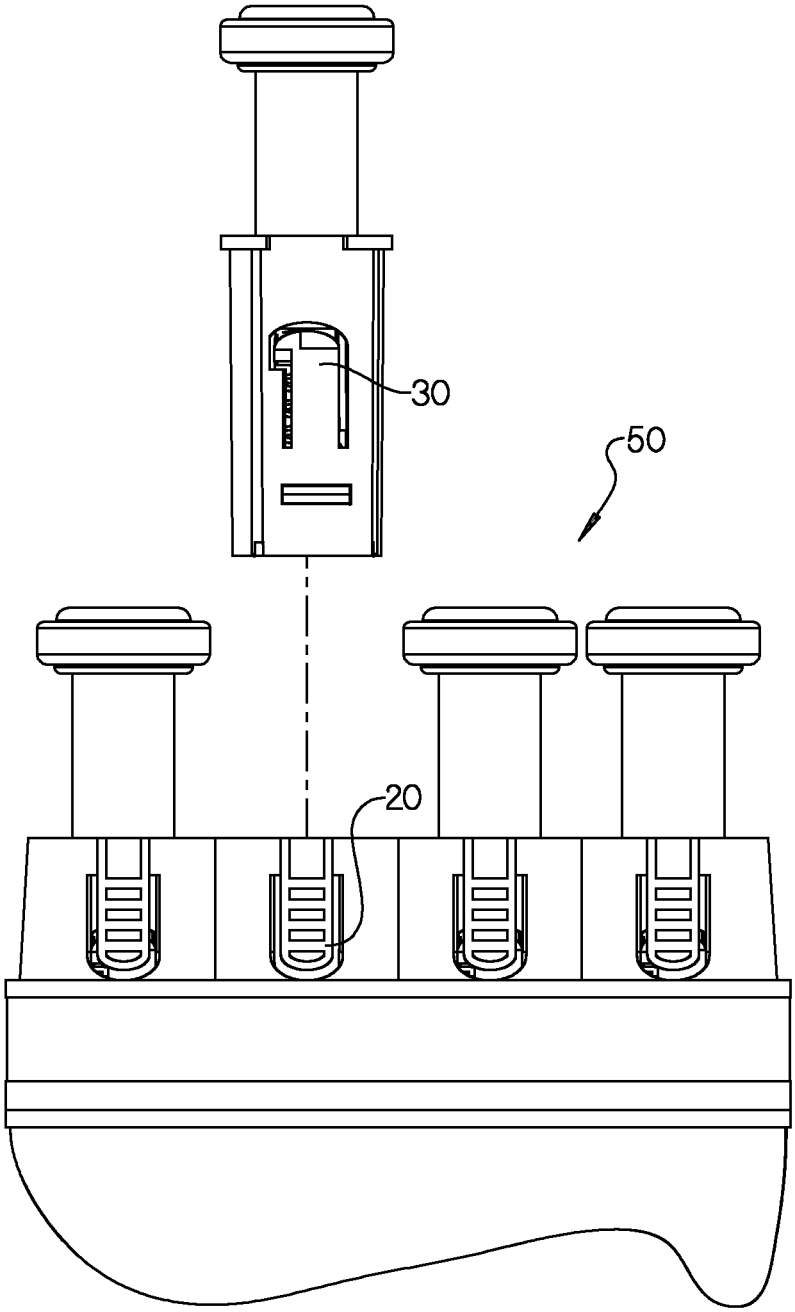
FIG. 11 illustrates a finger button piece removed from the second embodiment.
Figure 12:
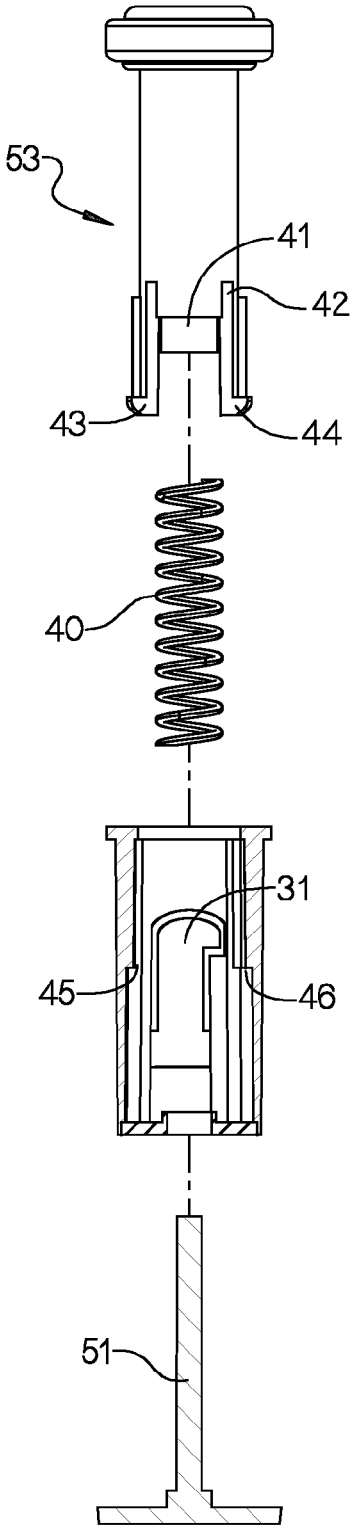
FIG. 12 is an exploded view of a finger button piece of the second embodiment and its central guide member.

This is best illustrated by FIGS. 9 and 10, where FIG. 9 is an exploded view showing the finger button piece in a locked position, and FIG. 10 is an exploded view showing the finger button piece in an unlocked position.

Figure 6:
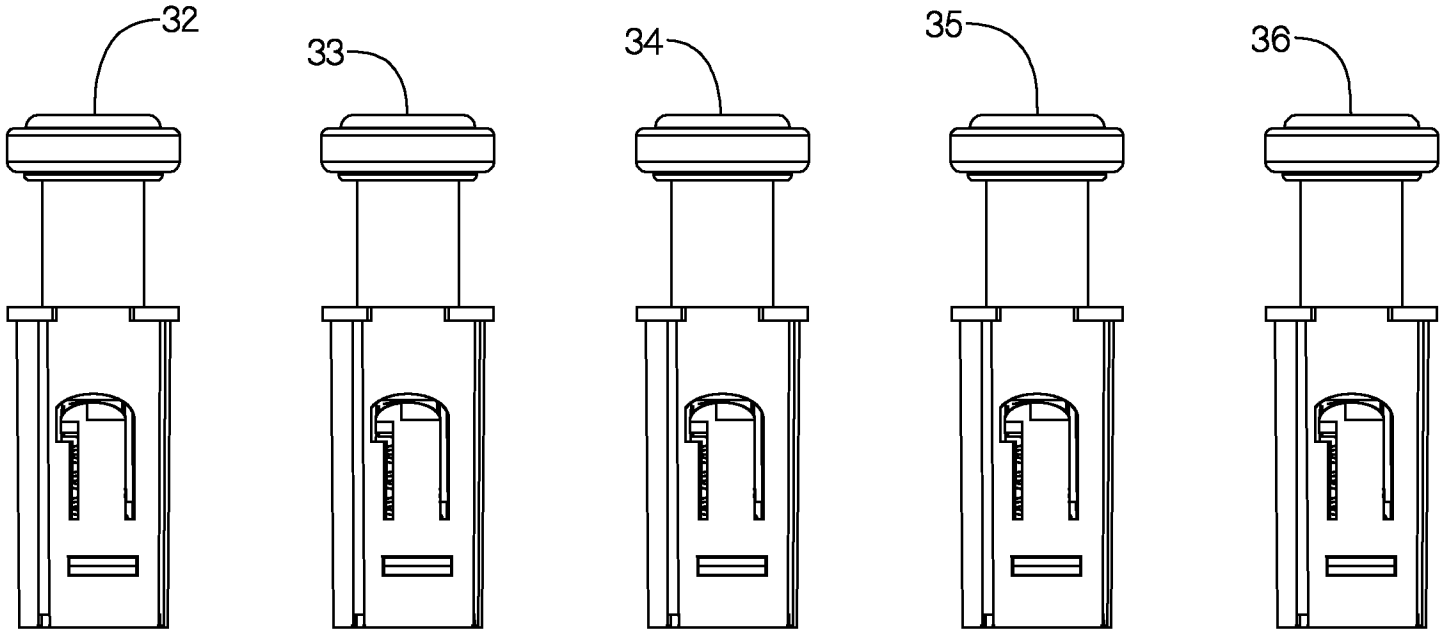
FIG. 6 is a view of a series of replacement finger button pieces having different resistances.

As shown in FIG. 6, there is provided additional finger button pieces 32, 33, 34, 35 and 36 to replace the matching finger button pieces with different resistance pieces and which may be color-coded.

For example, there may be eight levels of resistance or finger buttons available, such as, tan (xx-light), yellow (x-light), red (light), green (medium), blue (heavy), black (x-heavy), silver (xx-heavy), and gold (xxx-heavy).

The apparatus 50 shown in FIGS. 7-12 includes the fixed central axial guide pin device 51 affixed internally in the receptacle.

The finger button piece slides on the fixed central axial guide pin device 51.

While the present invention has been described in detail with reference to only two particular embodiments thereof, it should be understood that this has been described by way of illustration only, and not by way of limitation.

Reasonable variation and modification are possible within the spirit of the foregoing specification and drawings without departing from the scope of the invention which is defined in the accompanying claims.

The present invention embraces all embodiments, modifications, variations and changes which come within the scope of the patent claims set forth hereinbelow.

The invention claimed is:

1. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

2. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

interchangeable removable finger button pieces of different resistance ranging from extremely light resistance to extra heavy resistance;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

3. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

the interchangeable removable finger button piece snaps into the receptacle for selective retention therein;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

4. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

interchangeable removable finger button pieces of different resistance ranging from extremely light resistance to extra heavy resistance;

the interchangeable removable finger button piece snaps into the receptacle for selective retention therein;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

5. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

at least one of the receptacles is provided with a plurality of inwardly projecting elongated members;

at least one of the interchangeable removable finger button pieces is provided with a plurality of elongated notches which slidingly mate with the inwardly projecting elongated members of the receptacle;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

6. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

interchangeable removable finger button pieces of different resistance ranging from extremely light resistance to extra heavy resistance;

at least one of the receptacles is provided with a plurality of inwardly projecting elongated members;

at least one of the interchangeable removable finger button pieces is provided with a plurality of elongated notches which slidingly mate with the inwardly projecting elongated members of the receptacle;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

7. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

the interchangeable removable finger button piece snaps into the receptacle for selective retention therein;

at least one of the receptacles is provided with a plurality of inwardly projecting elongated members;

at least one of the interchangeable removable finger button pieces is provided with a plurality of elongated notches which slidingly mate with the inwardly projecting elongated members of the receptacle;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

8. A hand and finger exerciser apparatus, comprising:

a main base unit body structure;

a plurality of interchangeable removable finger button pieces connectible and cooperable with and slidable within said main base unit body structure;

each said interchangeable removable finger button piece providing a first predetermined resistance to pushing said interchangeable removable finger button piece inwardly into said main base unit body structure;

each interchangeable removable finger button piece being provided with an associated cooperating locking/unlocking means forming part of the main base unit structure for selectively and individually locking the interchangeable removable finger button piece to slide within the main base unit body structure while preventing removal of the interchangeable removable finger button piece from the main base unit body structure, and for selectively and individually unlocking the interchangeable removable finger button piece for removal from the main base unit body structure for replacement with another interchangeable removable finger button piece providing a second predetermined resistance to pushing said other interchangeable removable finger button piece inwardly into said main base unit body structure;

wherein said first predetermined resistance is different than said second predetermined resistance;

the main base unit body structure includes a plurality of receptacles;

each interchangeable removable finger button piece being designed and dimensioned to slide within an associated one of the receptacles;

the locking/unlocking means includes a first flexible member disposed on a side of the receptacle, and a second flexible member disposed on an opposite side of the receptacle;

pressing said first and second flexible members toward each other permits removal of the finger button piece from its receptacle;

interchangeable removable finger button pieces of different resistance ranging from extremely light resistance to extra heavy resistance;

the interchangeable removable finger button piece snaps into the receptacle for selective retention therein;

at least one of the receptacles is provided with a plurality of inwardly projecting elongated members;

at least one of the interchangeable removable finger button pieces is provided with a plurality of elongated notches which slidingly mate with the inwardly projecting elongated members of the receptacle;

each interchangeable removable finger button piece is provided with a third flexible member disposed on a side of the finger button piece, and a fourth flexible member disposed on an opposite side of the finger button piece; and pressing said first and second flexible members toward each other contacts and flexes the third and fourth flexible member inwardly to permit removal of the finger button piece from its receptacle.

9. The apparatus of claim 8, including:

a fixed central axial guide pin device affixed internally in the receptacle; and the finger button piece slides on the fixed central axial guide pin device.

* * * * *